United States Patent [19]

Gage

[11] 4,082,657

[45] Apr. 4, 1978

[54] SEPARATOR APPARATUS

[76] Inventor: Ernest L. Gage, Box 1687, Monahans, Tex. 79756

[21] Appl. No.: 650,286

[22] Filed: Jan. 19, 1976

[51] Int. Cl.[2] ..... B07B 1/28

[52] U.S. Cl. ..... 209/311; 209/405; 209/413; 210/329; 210/332; 210/389

[58] Field of Search ..... 209/325, 413, 311, 313, 209/314, 364, 405, 408, 409, 403; 248/354 H; 210/388, 389, 385, 384, 329, 332

[56] References Cited

U.S. PATENT DOCUMENTS

| | | | |
|---|---|---|---|
| 3,145,964 | 8/1964 | Groetschel | 248/354 H |
| 3,439,806 | 4/1969 | Kuss | 209/413 X |
| 3,642,133 | 2/1972 | Venanzetti | 209/314 |

FOREIGN PATENT DOCUMENTS

| | | | |
|---|---|---|---|
| 730,519 | 3/1966 | Canada | 209/314 |
| 1,153,971 | 3/1966 | Canada | 209/403 |

*Primary Examiner*—Robert Halper

*Attorney, Agent, or Firm*—Pravel, Wilson & Gambrell

[57] ABSTRACT

A new and improved separating device for separating particulate from a fluid stream including a plurality of screen units which are releasably held in a screen unit mounting assembly by inflatable tubes; the screen unit angular position is adjustable by adjusting the height of a plurality of adjustable support posts; and, dual vibrators are mounted with the screen unit mounting assembly and are interconnected for simultaneous vibration in mutually perpendicular directions.

5 Claims, 4 Drawing Figures

SEPARATOR APPARATUS

BACKGROUND OF THE INVENTION

The field of this invention is separators for separating particulate from a fluid stream. Separating devices for separating particulate such as drill cuttings from a fluid stream such as oil well drilling "mud" are known in the art. Although not particularly directed to the oil well drilling industry, there are numerous patents which have issued on separating devices. For example, U.S. Pat. No. 3,642,133 of Venanzetti discloses two parallel pluralities of vibrating screens which are mounted in cascaded alignment with each of the screens being resiliently mounted on a main frame for independent vibration. U.S. Pat. No. 3,834,534 of Peterson discloses a variable mode vibratory screen mounted at an incline angle wherein the vibration frequency is adjustable.

There are several very important problems which have not been fully solved by known vibrating devices. For example, the screen portions of known separating devices are quite cumbersome to remove and require that the entire separating device be shut down for extended periods. U.S. Pat. No. 3,406,823 of Crain discloses a releasable screen tensioning and connector spring which is designed to releasably connect the screen to a supporting frame. However, it is likely that the screen disclosed in the Crain patent cannot be removed very quickly because the screen includes a plurality of individual connectors which must be attached and then removed from the spring clips. U.S. Pat. No. 3,070,230 of Peterson discloses the use of a plurality of clips mounted in a screen border of resilient material for positioning over a frame flange. It is at least doubtful that the clips sufficiently secure the screen for continuous vibratory movement. U.S. Pat. No. 3,706,376 to Krause discloses the use of fastening clamps to actually mount the screen itself directly onto a strainer box.

Another difficulty with known separating devices is in making the angle of inclination of the screens adjustable for various applications. And, the placement and use of the vibrators for greater separating efficiency seems to be a never ending quest.

SUMMARY OF THE INVENTION

It is an object of this invention to provide a new and improved separating apparatus which provides for a very rapid release and replacement of screen units. It is another object of this invention to provide a separating device which adjustably mounts the screen units for use at various angular positions with respect to the ground. Further, the new and improved separating device of the preferred embodiment of this invention provides for the utilization of dual mounted fluid driven vibrators which are mounted for imparting vibratory motion in planes at substantially right angles with respect to each other. One vibrator is mounted on a screen unit mounting assembly in position to vibrate in a plane parallel to the plane of the screen unit mounted with the mounting assembly. A second vibrator is mounted adjacent to the first vibrator for imparting vibratory motion in a plane perpendicular to the plane of the mounted screen unit.

In the preferred embodiment of this invention, a plurality of posts are provided to support the screen unit mounting assemblies in various angular positions. Each of the posts include a hydraulically operated cap for adjusting the post height thereby adjusting the angular position of the screen mounting assembly which is resiliently supported on the posts.

The screen unit is releasably attached to the screen unit mounting assembly by the utilization of an inflatable tube which is attached to the screen mounting assembly and engages the screen unit for releasably maintaining the screen unit for vibratory movement with the screen unit mounting assembly.

DESCRIPTION OF THE PREFERRED EMBODIMENT

Figure 3:
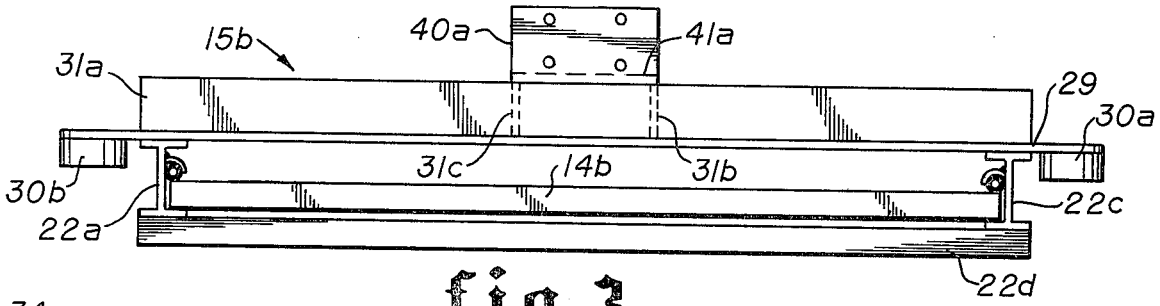
FIG. 3 is a front view of a screen unit mounting assembly with the screen unit in position with the mutually perpendicular positions of the vibrator mounting plates illustrated.

Referring to the drawings, the letter D generally designates the separating device of the preferred embodiment of this invention for separating particulate from a fluid stream. The separating device D includes a frame 10 having mounted thereon an inlet tank 11 for receiving a fluid to be filtered or cleaned. Screen units 14*a* and 14*b* are mounted in cascaded alignment on the frame 10 by vibration mount means generally designated as 15*a* and 15*b* which are basically identical except for position. The vibration mount means 15*a* and 15*b* each include a vibrating means 16 mounted therewith for vibrating screen units 14*a* and 14*b* simultaneously in mutually perpendicular directions.

The frame 10 includes first and second side members 10*a* (only one is illustrated) which are connected together by a front end connecting rod 10*b* and a rear connecting rod 10*c*. The front and rear connecting rods 10*b* and 10*c* cooperate with the side members such as 10*a* to provide a generally rectangular form having an opening therethrough through which the cleaned fluid stream may pass to a recovery area positioned therebelow. The side frame members such as 10*a* may be I-beams or other suitable frame members for supporting the structure to be disclosed here.

The fluid inlet means 11 includes a fluid inlet tank 11*a* which may be any suitable configuration. The fluid inlet tank 11*a* has connected therewith an inlet line 11*b* for receiving the fluids to be cleaned. The tank 11*a* has an outlet opening at 11*c*; and, the opening 11*c* has a hood or deflector 11*d* mounted thereover so that fluid directed outwardly of the tank 11*a* is directed downwardly toward the screen unit 14*b*.

Figure 4:
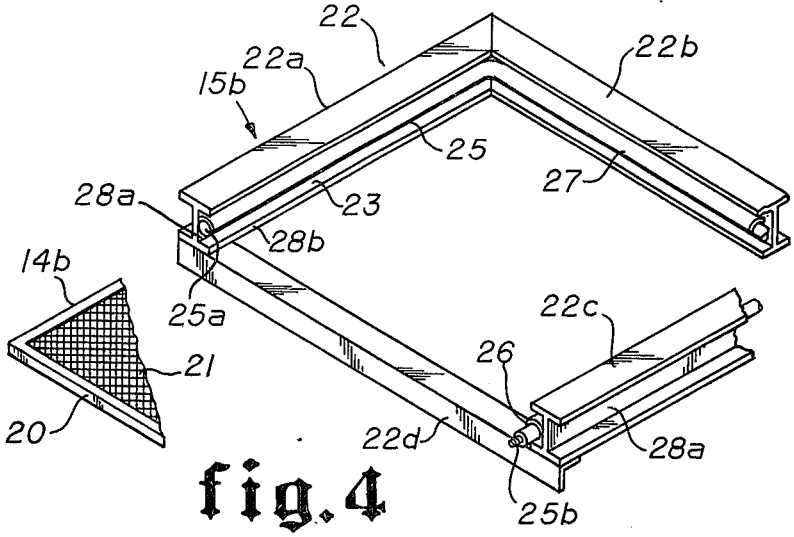
FIG. 4 is an isometric view of the screen unit mounting assembly illustrating the inflatable tube for releasably holding a screen unit in position for vibration.
Figure 1:
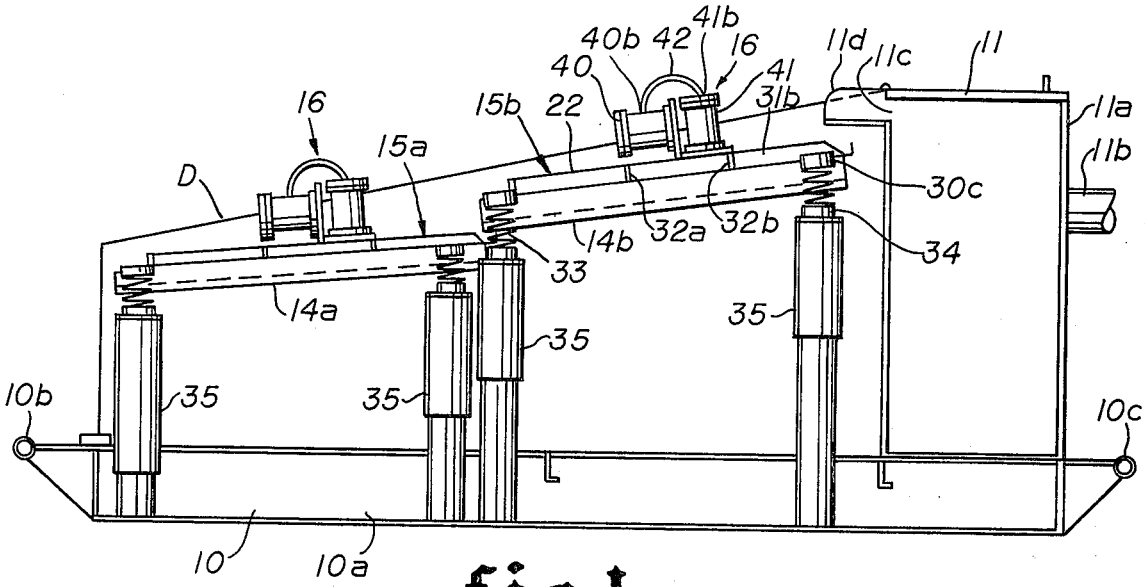
FIG. 1 is a side view partly in section of the new and improved separator apparatus of the preferred embodiment of this invention.

Referring in particular to FIGS. 1, 3 and 4, the vibration mount means 15*b* for the screen unit 14*b* is illustrated. It should be understood that the vibration mount means 15*a* for the screen unit 14*a* is identical. The screen unit 14*b* includes a square metal frame 20 which mounts a separating screen 21 thereon by suitable means such as by welding as described in the co-pending U.S. patent application Ser. No. 650,285, filed Jan. 19, 1976 entitled "Improved Separator Apparatus" invented by Ernest L. Gage and Roger A. Crocker. The screen unit 14*a* is identical to the screen unit 14*b*.

The screen unit 14*b* is releasably mounted in a screen unit mounting assembly 22. The screen unit mounting assembly 22 is square-shaped and includes sides 22*a*, 22*b* and 22*c* which are formed by I-beams. A front ledge is provided by front member 22*d*. Each of the three sides 22*a–c* and the ledge 22*d* are respectively connected by suitable means such as welding. The I-beams 22*a*, 22*b* and 22*c* cooperate to provide a three-sided recess generally designated by the number 23 to receive the screen unit 20.

Release means generally designated by the number 25 is mounted in the recess 23 for releasably holding the screen unit 14*b* in position for vibration with the screen unit mounting assembly 22. The release means 25 is formed by an inflatable tube 26 which extends along the perimeter of the three-sided recess 23 and is mounted underneath a curved channel portion 27 which is welded or otherwise attached to the web portion 28*a* of each of the I-beams 22*a–*22*c*. The inflatable tube is closed at one end 25*a* and has an air valve of a known variety at 25*b* for connection to a suitable air source for inflation. The channel 27 supports the inflatable tube 26 slightly above the bottom ledge 28*b* of the three I-beams 22*a–*22*c* so that the screen unit 20 may be easily inserted into the recess 23 below the tube 26. The tube 26 is then inflated through the air valve 25*b* thereby fully securing the screen unit 14*b* in position. Whenever it is necessary to replace the screen unit 14*b*, the air valve 25*b* is simply opened and the screen unit 20 is immediately released for removal and replacement.

A front bar 29 is mounted on the I-beams 22*a* and 22*c* and extends outwardly therefrom. Mounting cups 30*a* and 30*b* are welded on the underside thereof. Rear mounting cups such as 30*c* are mounted or attached to extend outwardly from the rear side I-beam 22*b* in alignment with the front mounting cups 30*a* and 30*b*. An upper support framework is provided by a front laterally extending bar 31*a* mounted onto the I-beam sides 22*a* and 22*c* adjacent to the bar 29. Two upper support bars 31*b* and 31*c* are connected between the rear side I-beam 22*b* and the frame member 31*a*. Laterally extending upper frame members or bars 32*a* and 32*b* are welded between the side I-beams 22*a* and 22*c* and the upper support bars 31*b* and 31*c* and between and the support bars 31*b* and 31*c* also. The upper frame members 31*a*, 31*b* and 31*c* cooperate with the upper frame members 32*a* and 32*b* to provide a latticework for supporting the vibrating means 16. A similar lattice framework is illustrated in the co-pending application Ser. No. 650,285. The mounting cups such as 30*a* and 30*b* are adapted to be lined with and mounted onto resilient springs 33. Each of the resilient springs 33 are in turn mounted or positioned in a hollow pod 34 which is mounted on top of each adjustable post 35. The adjustable posts 35 mount the springs 33 in position to receive the mounting cups such as 30*a* and 30*b* to resiliently mount the entire screen unit mounting assembly 22 with the screen unit 14*b* positioned therein for vibration therewith. Thus, there are four adjustable posts 35 which cooperate to provide adjustable support for the screen unit mounting assembly 22 and the screen unit 14*b* mounted therein. The exact structure of the adjustable posts 35 will be described shortly.

The vibration means 16 is mounted on each of the screen unit mounting assemblies 22 for each of the vibration mount means 15*a* and 15*b*. Referring in particular to FIGS. 1 and 3, the vibration means 16 includes a first or a master pneumatic vibrator 40 which is mounted on the screen unit mounting assembly 22 for vibration in a plane perpendicular to the plane of the screen unit 14*b*. A second or slave pneumatic vibrator 41 is mounted onto the screen unit mounting assembly 22 for vibration in a plane parallel to the mounted screen unit 14*b*. A mounting plate 41*a* is welded to the upper frame members 31*b* and 31*c* in a plane parallel to the screen unit 14*b* and another mounting plate 40*a* is welded or otherwise attached to and extends perpendicularly from the mounting plate 41*a*. The master pneumatic vibrator 40 is bolted to the mounting plate 40*a* and the slave vibrator unit 41 is bolted to the mounting plate 41*a*. The pneumatic vibrators 40 and 41 are of a type of pneumatic vibrator available under the brand name Ben Master manufactured by National Air Vibrator Company of Houston, Texas. The outlet 40*b* for the master vibrator 40 is connected by an air line 42 to the inlet 41*b* of the slave vibrator 41 such that the slave vibrator 41 is actually powered by the exhaust of the master vibrator 40 so that the screen units 14*a* and 14*b* are vibrated substantially simultaneously in mutually perpendicular planes. Of course, the vibrating means 16 for the vibration mount means 15*a* for screen unit 14*a* is identical. The combination of the master and slave vibrators provides unique efficiency in separating particulate from a stream flowing across the screen units 14*a* and 14*b*.

Figure 2:
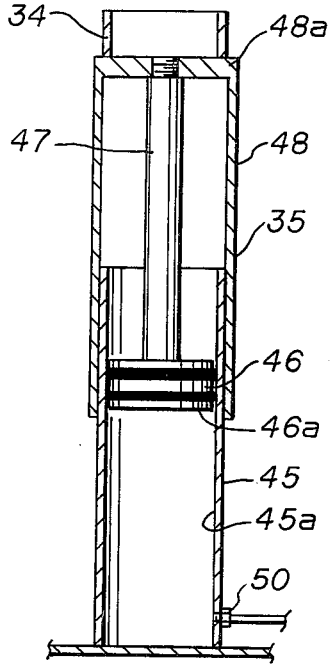
FIG. 2 is a sectional view of one of the vertically adjustable posts which are used to support the screen units and screen unit mounting assemblies at various angular positions.

FIG. 2 illustrates in detail the structure of each of the posts 35. A central post member 45 is mounted onto a frame side such as 10*a*. The central post member 45 includes a hollow portion 45*a* for receiving a piston 46 having suitable seal rings such as 46*a* thereon such that the piston is mounted for slidable, sealable movement therein. A rod 47 is mounted onto and extends upwardly from the piston into threaded engagement with a cap 48. The cap 48 is a hollow, cylindrical sleeve having a closed top portion 48*a*. The hollow mounting pod 34 previously mentioned is mounted thereon for receiving the springs 33. A combination fluid inlet and outlet 50 is positioned in the central post member 45*a* below the piston 45. Hydraulic fluid or air under pressure may be pumped into the central post portion 45 below the piston 46 in order to displace the piston upwardly thereby adjusting the overall height of the cap 48 and thus of the posts 35.

A combination of four of the adjustable posts 35 cooperates with the springs 33 to resiliently mount the screen unit mounting assembly 22 with the screen unit 14*b* therein. The height of each of the posts 35 is adjustable so that the angle of inclination of the screen unit 14*b* may be adjusted from a horizontal position to an inclined angle with respect to the horizontal.

In operation and use of the separating device D of the preferred embodiment of this invention, the device D is mounted over a collection or recovery area such as a mud pit which is part of a return circulating system for an oil well drilling operation. The drilling fluid or mud which has been circulated upwardly from down the bore hole is passed through line 11*b* into the tank 11*a* and is directed outwardly of opening 11*c* over the cascadedly positioned screen frame members 14*b* and 14*a*. Screen frame members 14*b* and 14*a* are vibrated by the combination master and slave pneumatic vibrators 40 and 41. And, the angle of inclination of the screen frame members 14*a* and 14*b* is adjustable by adjusting the necessary posts 35 as previously described. The fluid directed outwardly of the tank opening 11*c* is passed through the vibrating screens 14*b* and 14*a* thus removing therefrom undesirable solids or particulate. These solids or particulate may be vibrated off of the separating device D and collected outwardly of the recovery area. Whenever it is necessary to replace one of the screen units such as 14*b*, the inflatable tube or hose 25 is at least partly deflated by draining air out of the air valve 25*b*. This releases the screen unit such as 14*b* for quick replacement. Thus, there is very little lost time in shutting down the entire device D in order to change the screen units 14*a* and 14*b*, a substantial advantage.

The foregoing disclosure and description of the invention are illustrative and explanatory thereof, and various changes in the size, shape and materials as well as in the details of the illustrated construction may be made without departing from the spirit of the invention. For example, the number of screen units such as 14*a* or 14*b* may be two as described in the embodiment herein or any other number.

I claim:

1. A separating device for separating particulate from a fluid stream, comprising:

a frame adapted for positioning over a recovery area;

a plurality of screen units, each of said screen units including a screen for receiving such fluid stream and separating particulate therefrom as said fluid stream passes through said screen to such recovery area;

a plurality of screen units mounting assemblies mounting each of said screen units;

vibration mount means mounting each of said screen unit mounting assemblies for vibratory motion with respect to said frame;

fluid inlet means mounted with said frame for receiving said fluid stream and directing said fluid stream over said vibrating screen units;

each of said screen unit mounting assemblies having release means for releasably mounting one of said screen units for vibratory motion, said release means including inflatable means movable between a screen unit holding position when inflated, in which position said inflatable means engages and holds said screen unit for vibration, and a screen unit releasing position when deflated, in which said screen unit is released from engagement with said screen unit mounting assembly so that said screen unit is easily removed;

vibrating means mounted with each of said screen unit mounting assemblies for vibrating such screen unit mounting assembly and said screen unit mounted therein by said release means for vibratory movement in mutually perpendicular directions;

said vibration mount means including a plurality of posts mounted with said frame for each screen unit, means mounting each of said screen mounting assemblies on a plurality of said posts, said posts having height adjustment means for adjusting the height of said posts in order to adjust the angular position of each of said screen mounting assemblies and screen units mounted therewith;

said height adjustment means including a cap mounted over said posts for vertical movement with respect thereto; and means for vertically adjusting said cap with respect to said post.

2. The structure set forth in claim 1, wherein said vibrating means includes:

first and second vibrators mounted with each screen unit for vibration in first and second mutually perpendicular planes.

3. The structure set forth in claim 2, including:

said first vibrator being mounted for vibration in a plane parallel to said screen unit and said second vibrator being mounted for vibration in a plane perpendicular to said screen unit.

4. The structure set forth in claim 3, including:

both said first and second vibrators being pneumatically driven; and means connecting the inlet of said first vibrator to the exhaust of said second vibrator such that said first vibrator is powered by air from the exhaust of the second vibrator.

5. The structure set forth in claim 1, including:

said posts being hollow; and pistons mounted for slidable, sealable movement in said posts, each of said pistons being connected to one of said caps by a rod whereby the entry of fluid below said piston will cause said cap for each post to move upwardly.

* * * * *